US008353501B2

(12) United States Patent
Poppe

(10) Patent No.: US 8,353,501 B2
(45) Date of Patent: Jan. 15, 2013

(54) FOAM SPRING FOR PILLOWS, CUSHIONS, MATTRESSES OR THE LIKE AND A METHOD FOR MANUFACTURING SUCH A FOAM SPRING

(76) Inventor: Willy Poppe, Sint-Niklaas (BE)

( * ) Notice: Subject to any disclaimer, the term of this patent is extended or adjusted under 35 U.S.C. 154(b) by 222 days.

(21) Appl. No.: 12/386,931

(22) Filed: Apr. 24, 2009

(65) Prior Publication Data

US 2010/0270718 A1 Oct. 28, 2010

(51) Int. Cl.
*F16F 1/00* (2006.01)

(52) U.S. Cl. ..... 267/142; 5/655.9

(58) Field of Classification Search ..... 267/142, 267/143, 144, 145, 146, 152; 5/655.9, 718, 5/719, 740

See application file for complete search history.

(56) References Cited

U.S. PATENT DOCUMENTS

| | | | | |
|---|---|---|---|---|
| 2,604,642 | A | | 7/1952 | Marco |
| 3,017,642 | A | | 1/1962 | Rosenberg et al. |
| 4,194,255 | A | * | 3/1980 | Poppe ..... 267/153 |
| 4,667,357 | A | | 5/1987 | Fortune |
| 4,901,387 | A | | 2/1990 | Luke |
| 5,079,790 | A | | 1/1992 | Pouch |
| 5,107,558 | A | | 4/1992 | Lück |
| 5,231,717 | A | | 8/1993 | Scott et al. |
| 5,325,552 | A | | 7/1994 | Fong |
| 5,353,455 | A | | 10/1994 | Loving et al. |
| 5,960,496 | A | | 10/1999 | Boyd |
| 6,036,271 | A | | 3/2000 | Wilkinson et al. |
| 6,061,856 | A | | 5/2000 | Hoffmann |
| 6,154,690 | A | | 11/2000 | Coleman |
| 6,286,167 | B1 | | 9/2001 | Stolpmann |
| 6,347,423 | B1 | | 2/2002 | Stumpf |
| 6,581,229 | B2 | | 6/2003 | Bernstein |
| 6,585,328 | B1 | | 7/2003 | Oexman et al. |
| 6,704,962 | B2 | | 3/2004 | Choi |
| 6,745,420 | B2 | | 6/2004 | Giori et al. |
| 6,889,398 | B2 | | 5/2005 | Lewis |
| 6,922,862 | B1 | | 8/2005 | Thompson |
| 7,000,277 | B2 | | 2/2006 | Cervera |
| 7,120,956 | B1 | | 10/2006 | Liao |
| 7,178,187 | B2 | | 2/2007 | Barman et al. |
| 7,222,379 | B2 | | 5/2007 | DiGirolamo |
| 7,325,267 | B2 | | 2/2008 | Slettaoyen |
| 7,428,764 | B2 | | 9/2008 | Clark |

(Continued)

FOREIGN PATENT DOCUMENTS

DE 10306039 A1 9/2004

(Continued)

*Primary Examiner* — Robert A Siconolfi
*Assistant Examiner* — Vu Q Nguyen
(74) *Attorney, Agent, or Firm* — McKenna Long & Aldridge LLP

(57) ABSTRACT

A foam spring for use in pillows, cushions, mattresses or the like, the foam spring having a tubular resilient body (2) made of foam and forming an outer wall, with holes (3) extending inwardly from an outside surface (4) to an inside surface (5), those holes (3) being arranged in a staggered symmetry and mainly being diamond shaped, characterized in that the tubular body (2) displays said holes (3) only over a limited part (16) of its surface (4), and that this limited part (16) is regularly alternating with a limited part (18) of the surface (4) that is not provided with said holes (3) and which forms longitudinal reinforcement ribs (7) in the wall of the tubular body (2) of the spring (1).

26 Claims, 2 Drawing Sheets

U.S. PATENT DOCUMENTS

| | | | | |
|---|---|---|---|---|
| 7,496,981 | B2 | 3/2009 | Cucurull | |
| 7,624,462 | B2 | 12/2009 | Cao et al. | |
| 7,685,663 | B2 | 3/2010 | Rawls-Meehan | |
| 2002/0013743 | A1 | 1/2002 | Shoffner | |
| 2002/0113346 | A1 | 8/2002 | Constantinescu | |
| 2002/0124320 | A1 | 9/2002 | Washburn et al. | |
| 2003/0101517 | A1 | 6/2003 | Choi | |
| 2004/0077921 | A1 | 4/2004 | Becker et al. | |
| 2004/0133987 | A1 | 7/2004 | Reeder et al. | |
| 2005/0108827 | A1 | 5/2005 | Cervera | |
| 2005/0115003 | A1 | 6/2005 | Torbet et al. | |
| 2005/0172468 | A1 | 8/2005 | Poppe | |
| 2005/0223667 | A1 | 10/2005 | McCann et al. | |
| 2006/0248652 | A1 | 11/2006 | Cucurull | |
| 2006/0282954 | A1 | 12/2006 | Poppe | |
| 2006/0290039 | A1 | 12/2006 | Cao et al. | |
| 2007/0021965 | A1 | 1/2007 | Boyd | |
| 2007/0086947 | A1 | 4/2007 | Boyd | |
| 2007/0204407 | A1 | 9/2007 | Lee | |
| 2008/0093784 | A1 * | 4/2008 | Rawls-Meehan | 267/80 |
| 2008/0097774 | A1 | 4/2008 | Rawls-Meehan | |
| 2008/0097778 | A1 | 4/2008 | Rawls-Meehan | |
| 2008/0097779 | A1 | 4/2008 | Rawls-Meehan | |
| 2008/0127424 | A1 | 6/2008 | Rawls-Meehan | |
| 2008/0162171 | A1 | 7/2008 | Rawls-Meehan | |
| 2008/0184492 | A1 | 8/2008 | Sunde | |
| 2008/0281611 | A1 | 11/2008 | Rawls-Meehan | |
| 2008/0281612 | A1 | 11/2008 | Rawls-Meehan | |
| 2008/0281613 | A1 | 11/2008 | Rawls-Meehan | |
| 2008/0288272 | A1 | 11/2008 | Rawls-Meehan | |
| 2008/0288273 | A1 | 11/2008 | Rawls-Meehan | |
| 2009/0018853 | A1 | 1/2009 | Rawls-Meehan | |
| 2009/0018854 | A1 | 1/2009 | Rawls-Meehan | |
| 2009/0018855 | A1 | 1/2009 | Rawls-Meehan | |
| 2009/0018856 | A1 | 1/2009 | Rawls-Meehan | |
| 2009/0018857 | A1 | 1/2009 | Rawls-Meehan | |
| 2009/0018858 | A1 | 1/2009 | Rawls-Meehan | |
| 2009/0024406 | A1 | 1/2009 | Rawls-Meehan | |
| 2009/0037205 | A1 | 2/2009 | Rawls-Meehan | |
| 2009/0043595 | A1 | 2/2009 | Rawls-Meehan | |
| 2009/0049615 | A1 | 2/2009 | Poppe | |
| 2009/0064420 | A1 | 3/2009 | Rawls-Meehan | |
| 2009/0071302 | A1 | 3/2009 | Poppe | |
| 2009/0079119 | A1 | 3/2009 | Poppe | |
| 2009/0100603 | A1 | 4/2009 | Poppe | |
| 2009/0183314 | A1 | 7/2009 | Demoss | |
| 2010/0025900 | A1 | 2/2010 | Rawls-Meehan | |
| 2010/0090383 | A1 | 4/2010 | Rawls-Meehan | |

FOREIGN PATENT DOCUMENTS

| | | | |
|---|---|---|---|
| DE | 10 2008 055 549 | A1 | 7/2010 |
| EP | 0 001 469 | A1 | 4/1979 |
| EP | 0 624 332 | A1 | 11/1994 |
| EP | 0 872 198 | A2 | 10/1998 |
| EP | 0793932 | B1 | 8/2002 |
| EP | 1046365 | B1 | 5/2003 |
| EP | 1872692 | | 1/2008 |
| WO | WO 03/003878 | A2 | 1/2003 |
| WO | WO 2005/020761 | A1 | 3/2005 |
| WO | WO 2005/074752 | A1 | 8/2005 |
| WO | WO 2007/087695 | A2 | 8/2007 |
| WO | WO 2008/048743 | A2 | 4/2008 |
| WO | WO 2009/023940 | A1 | 2/2009 |
| WO | WO 2009/036524 | A1 | 3/2009 |

* cited by examiner

FOAM SPRING FOR PILLOWS, CUSHIONS, MATTRESSES OR THE LIKE AND A METHOD FOR MANUFACTURING SUCH A FOAM SPRING

FIELD OF THE INVENTION

The present invention concerns an improved foam spring, in particular an improved foam spring with a tubular resilient body made of foam with holes extending inwards from the outside and which can be applied in the core of pillows, mattresses, armchair cushions or the like.

The invention also concerns a method for manufacturing such an improved foam spring.

BACKGROUND OF THE INVENTION

Foam springs are known for example from European Patent Publication EP 0.001.469, teaching an elastic spring element and a method to produce the same, characterized by the fact that it mainly consists of a tubular body, made of synthetic foam material or the like, whereby the wall of the body displays a number of hollows in staggered symmetry, the cross-sectional surface of which varies from practically zero at the inner wall of the body, to a maximum value at the outer wall, no load being applied.

In order to establish the desired resilience of the spring, it is taught to fit at least one core of elastic springy material in aforesaid tubular body, whereby the diameter of the former mainly corresponds to the internal diameter of the tubular body.

Also known from European Patent Publication EP 0.624.332 is an elastic springy element which comprises a tubular foam body which is provided with holes extending inwards from the outside, characterized in that it comprises a wire spring which is surrounded by the body.

As opposed to an elastic springy material consisting of only foam, it is claimed that no hardness loss occurs with a fatigue test when using normal and therefore cheaper types of foam for the construction of the tubular body.

Known in the art is also from U.S. Published Patent Application 2005/0172468 a method for manufacturing a tubular resilient body for pillows, mattresses and the like which method consists in providing slits in a foam layer, in cutting a strip out of this foam layer; in bending two opposite ends of the strip towards each other; and in fixing both these far ends in order to form the aimed tubular resilient body, whereby the foam layer is made of what is called a visco-elastic foam, and whereby at least a part of the cells, present in the foam, are broken open.

The tubular body formed this way is hereby preferably given a biconical or almost biconical outer shape.

It is claimed that, contrary to common supple resilient foam bodies made of foam having a low specific gravity, such as the tubular resilient body is not losing its resilience over a short period of time of actual use, as a result of which it is capable of maintaining its functionality for a longer period of time when being applied in pillows or the like.

Also known in the art are, as disclosed in European Patent Publication EP 0.872.198, foam springs which comprise a tubular body of foam which is provided in its walls with cavities which are directed inwardly from the outside, characterized in that the body is widening-narrowing from one extremity to another, resulting in a barrel shaped outside form, i.e. in case the body has a round configuration to start with.

As a main advantage of these springs it is claimed that, contrary to common embodiments, they are less easily fatigued and do not lose their initial height and shape after a short useful life time.

Known are also foam springs from Published International PCT Application WO 2009/036524 for the use in pillows, mattresses or the like, that have a tubular resilient body made of foam, with holes extending inwardly from the outside surface to an inside surface, wherein the tubular body comprises at least one tubular foam layer and at least one reinforcing layer applied to said foam layer over at least a part of the axial length of the spring.

It is claimed that the resilient behaviour of such a spring can easily be adapted by using a reinforcing layer with a different stretch resistance.

Although such known foam springs are very much valued by the users of the pillows, mattresses or the like, they have the disadvantage that either a particular shape has to be given to the outside of the spring, therefore making a close and dense packing of the springs next to each other more difficult, or that additional components like wire springs or reinforcing cores or special backings or reinforcing layers need to be provided, which makes the manufacturing of such springs more complicated, more expensive, more energy consuming and more polluting for the environment.

They also have the disadvantage that they are easily damaged, for example during manufacturing, packaging, storage, transport, installation etc. or when assembling the pillows, mattresses or the like, due to high stretching forces applied to the springs.

Therefore, handling of those springs needs to be done with some caution, which involves special care, often resulting in a slower production process and higher production costs.

Another drawback of the known springs is that, when they are compressed in the axial direction, they tend to bulge out in a lateral direction, hence influencing the behaviour of the adjoining springs.

Therefore the elastic behaviour of individual springs in a pillow, mattress or the like is sometimes difficult to predict so that accommodating a pillow, mattress or the like to a user's need or body shape is not an easy task.

SUMMARY OF THE INVENTION

It is an object of the present invention to provide a foam spring with improved properties for use in pillows, cushions, mattresses or the like, that does not exhibit any of the aforementioned or other disadvantages.

To this end, the invention concerns a foam spring for use in pillows, cushions, mattresses or the like, the foam spring having a tubular resilient body made of foam and forming an outer wall, with holes extending inwardly from an outside surface to an inside surface, those holes being arranged in a staggered symmetry and mainly being diamond shaped, characterized in that the tubular body displays said holes only over a limited part of its surface, and that this limited part is regularly alternating with a limited part of the surface that is not provided with said holes and which forms longitudinal reinforcement ribs in the wall of the tubular body of the spring.

A major advantage is that, together with their even spacing in the tubular body of the spring, the reinforcement ribs allow for a very much improved distribution of the compression forces when the spring is under load, not necessitating anymore the incorporation of a metal spring or additionally reinforcements, or the use of foam layers of different density, or the like, as taught in the prior art.

Additionally, the reinforcement ribs formed according to the invention, prevent the foam better from bulging out side ways when compressed under load, even when a lower density foam is used to form the body.

The use of a lower density foam, without loss of the major static and dynamic properties of the spring, does not only reduce the raw materials cost and energy consumption providing at the same time important gains in production time, but also gives a better comfort feel and adaptability of the foam to the body shape when used in mattress, pillow, cushion or the like, which tend to be much appreciated and valued by the end-user.

A comparable or even better static, dynamic and long term behaviour of the spring can thus be obtained in a much simpler and less cost effective way than with springs according to the prior art.

A major advantage is that the reinforcement ribs form an integral part of the tubular body and are produced in one and the same production step, not creating any problems of adhesion, delamination, assembly, storage and procurement of individual components etc.

Another advantage is that, as a result of this, the springs are less prone to damage due to rough handling during manufacturing and assembly of a pillow, mattress or the like.

Therefore less care has to be taken not to damage the springs during production, assembly, handling, storage, installations etc. which invariably results in higher production speeds and a reduction of overall reject rates.

The longitudinal reinforcement ribs created according to the invention will in turn prevent the elastic properties of the springs from being less influenced by adjoining compressed springs, making the resilient behaviour of each individual spring better predictable when used in a pillow, mattress or the like.

Due to this more predictable behaviour of the springs, it is easier to tailor a pillow, mattress or the like to a user's particular preference or to his body shape and weight in order to give the user a great feeling of comfort.

Another advantage of the springs according to the invention is that, due to the creation of the evenly spaced reinforcement ribs and the absence of other constructional elements, like e.g. metal wire springs, in the tubular wall, the springs are better resistant against damage due to rough handling during manufacturing and assembling of the pillow, mattress or the like, and considerably reduces their weight and complexity.

Another advantage is that the resilient behaviour of the spring according to the invention can easily be adjusted not only by a judicious choice of the raw materials and the foam made therefrom, but also by the relative proportion of the parts that are provided with holes and the ones that are not and by their geometrical arrangement and relative distribution along the body of the spring.

These foam springs according to the invention can of course be combined with other types of springs in order to create different comfort zones with different softness in a pillow, mattress or the like.

According to a preferred embodiment, the part of the body that is not provided with holes and therefore forms a plurality of reinforcement ribs extends from the bottom till the top of the tubular body.

According to another preferred embodiment the width of the part provided with holes is essentially equal to the width of the part not provided with said holes, determined on the non extended foam.

According to a further preferred embodiment the holes are not only staggered with respect to each other, but also with respect to the holes formed in any adjacent part that is separated from these parts by a part that is not provided with said holes.

According to a further preferred embodiment the outside surface of the part that is not provided with holes exhibits a sine shape over a part or over the total axial length of the spring.

According to a further preferred embodiment the non perforated parts form a plurality of reinforcement ribs equally spaced along the periphery of the tubular body and along its longitudinal axis.

According to a further preferred embodiment the number of the parts that are not provided with holes and thus form reinforcement ribs lies between 4 and 12, preferably between 6 and 10, more preferably equals 8.

According to a further preferred embodiment the spring comprises a strip with at least one foam layer and a series of slits extending in one direction and surrounded by corresponding areas that do not contain any slits, and two opposite ends extending in the direction of the slits, the opposite ends of the strip being bent into proximity to each other and glued together to form said hollow tubular body and to form said holes into a diamond shape by stretching the slits in a transverse direction due to the bending of the strip, and to turn the non slotted areas into reinforcing ribs regularly spaced along the periphery of the tubular body and aligned along its longitudinal axis.

According to a further preferred embodiment the slits in the strip extend along a plurality of interrupted parallel lines.

According to a further preferred embodiment the slits in the strip are positioned according to a staggered pattern, wherein the slits along adjacent lines are offset in their longitudinal direction.

According to a preferred embodiment the slits in the strip between two adjacent areas that are separated by a non slotted area, are positioned according to a staggered pattern, wherein the slits along adjacent lines are offset in their longitudinal direction.

The invention also relates to a method for manufacturing a foam spring with a tubular, resilient body for use in pillows, mattresses or the like, which method comprises providing interrupted slits along lines extending in the longitudinal direction of at least one part of a foam layer and alternating those slits in a regular pattern with an adjacent part of the foam layer not provided with said slits, cutting a transverse strip out of this foam, bending two opposite ends of the strip towards each other; and fixing the two opposite ends into a tubular shape to form the tubular resilient body, in which on the outside and along the longitudinal axis of the tubular body, the parts with slits and the adjacent parts without slits are alternating in a regular fashion, and in which the latter form solid longitudinal reinforcement ribs in the tubular body of the spring.

BRIEF DESCRIPTION OF THE DRAWINGS

In order to better explain the characteristics of the invention, the following preferred embodiment of a foam spring and of a method according to the invention for manufacturing such a foam spring is described as an example only, without being limitative in any way, with reference to the accompanying drawings, in which.

DESCRIPTION OF THE PREFERRED EMBODIMENT

Figure 1:
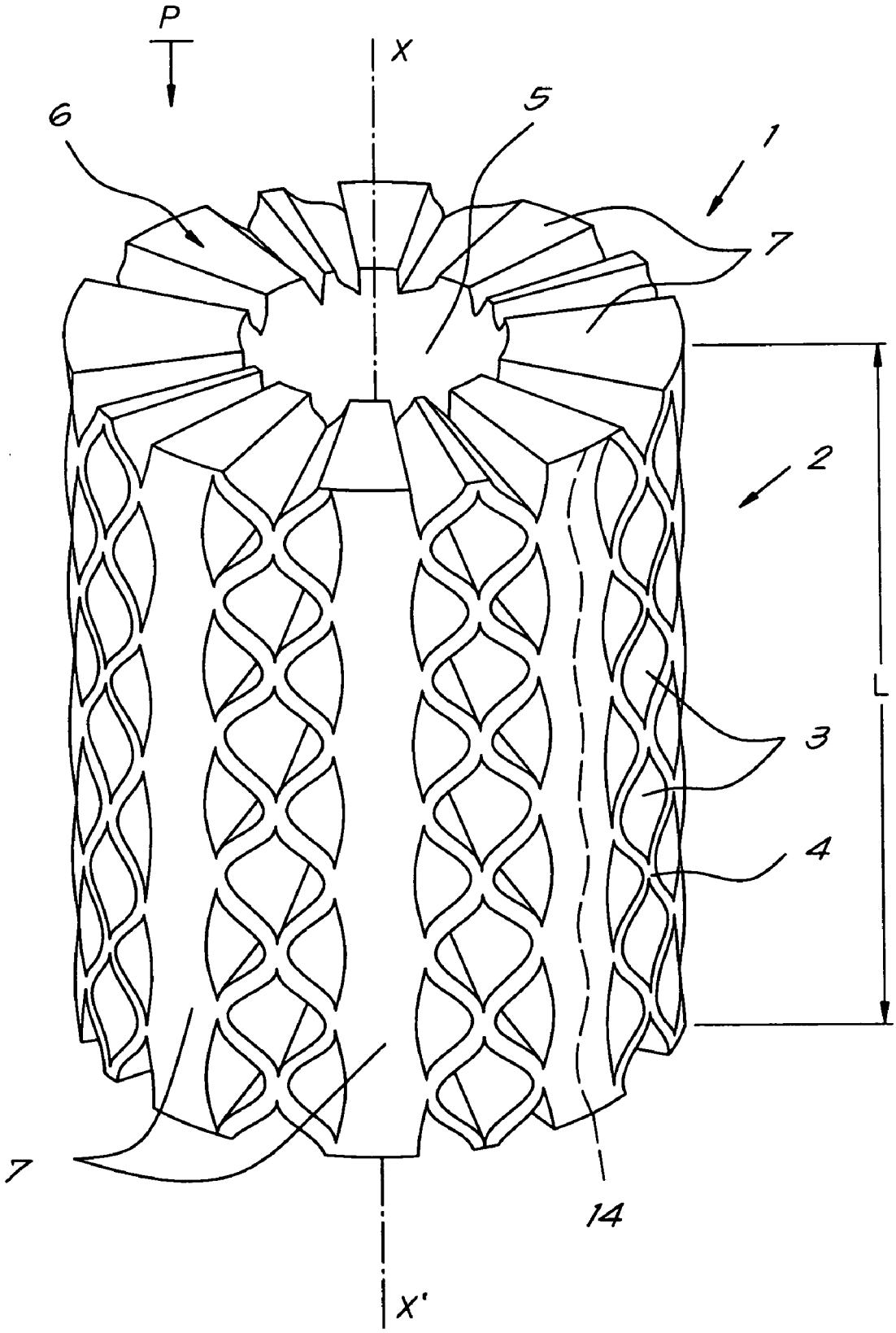
FIG. 1 represents a schematic perspective view of a foam spring according to the invention.

The spring represented in FIG. 1 is a foam spring 1 for use in pillows, cushions, mattresses or the like, and comprises a tubular resilient body 2 with holes 3 extending inwardly from the outside surface 4 to the inside surface 5 of the spring 1.

The tubular body 2 further comprises a foam layer 6.

The holes 3 are hereby preferably arranged in a regular and staggered pattern compared with one another.

This allows for any deformation of the spring 1 under compression along the direction represented by the arrow P to be evenly distributed over the entire body of the spring 1, thus limiting any radial bulging out of the spring 1 and preventing compression forces to be concentrated only in one part of the spring 1 instead of being evenly distributed over the entire body 2 of spring 1.

Areas 16 (represented in FIG. 2) containing those holes 3 are alternated with areas 18 (represented in FIG. 2) not containing any holes 3, the latter forming reinforcement ribs 7 that are evenly distributed along the periphery of the tubular body 2.

In a preferred embodiment the shape of the reinforcement ribs 7 is a sine wave or follows a continuous Z or S line in the longitudinal direction X-X', as represented by the dotted line 14.

An advantage of a foam spring 1 as represented in FIG. 1 is that, when the spring is compressed in the axial direction X-X' as represented by arrow P, the foam spring 1 does not have the tendency to bulk out in a radial or lateral direction and that hence the diameter of the tubular spring is essentially preserved.

Another advantage of this preferred embodiment is that the resilience, compressive strength, and useful life time of the spring 1 according to the invention are markedly enhanced, even when lower density foam is used for its construction.

Figure 2:
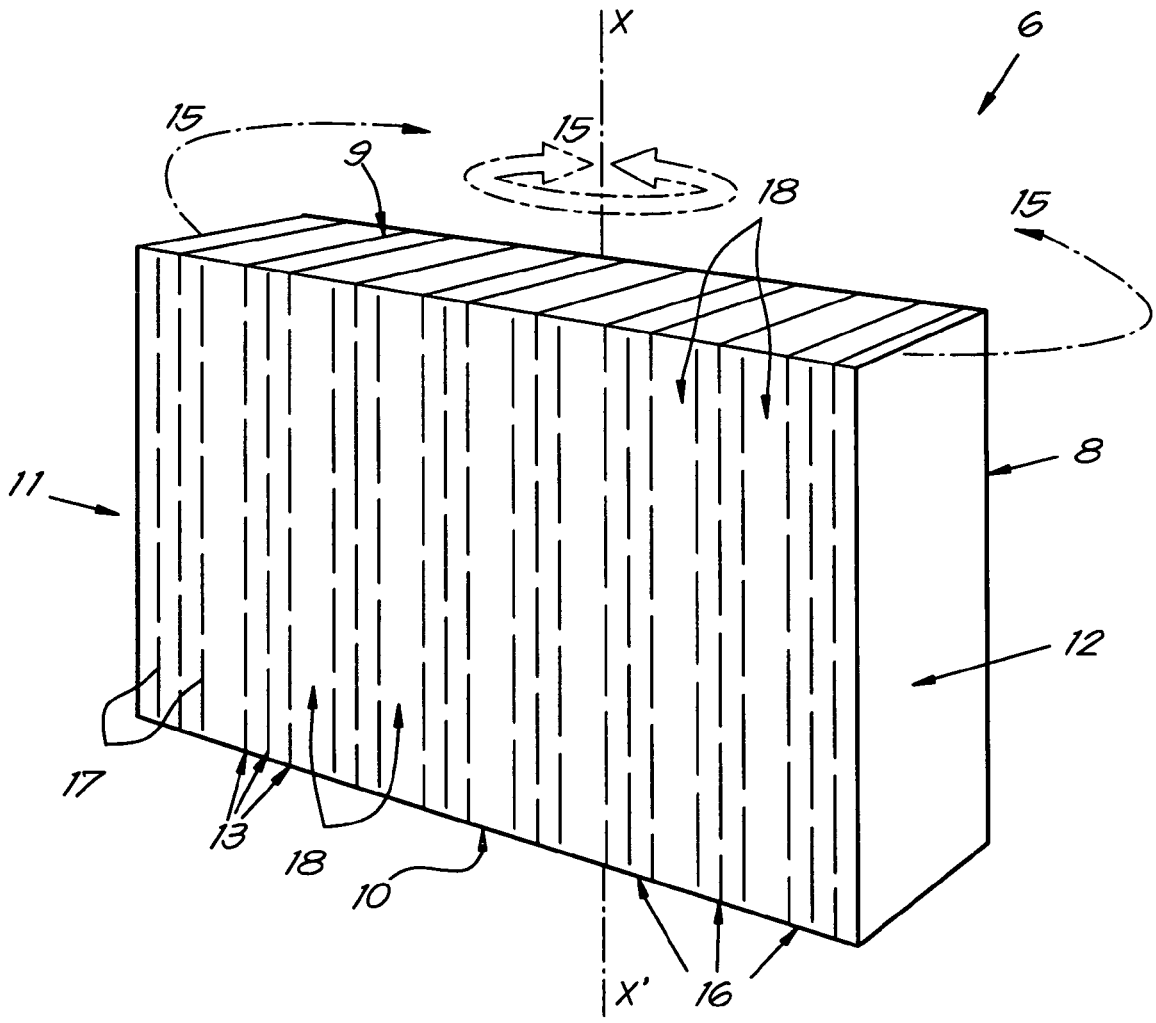
FIG. 2 represents a foam layer with evenly spaced areas containing slits, alternating with areas not containing any slits, used for manufacturing a foam spring according to the invention.

FIG. 2 represents a foam layer 6 out of which according to the invention the foam spring 1 is made.

The method to form the foam spring 1 is relatively simple and comprises the following steps:

In a first step a rectangular strip 8 is cut out of a suitable foam layer 6 with an axis of symmetry X-X' and with two pairs of parallel side walls 9-10 and 11-12 respectively.

In the strip 8 areas 16 with slits 17 are provided, according to a direction which is parallel to the aforesaid axis of symmetry X-X', and alternating, in a regular pattern, with areas 18 without slits 17.

The slits 17 in the strip 8 are cut along a plurality of interrupted parallel lines 13 at an equal distance from each other.

The slits 17 are advantageously positioned according to a staggered pattern, whereby the slits 17 along adjacent lines 13 are offset in their longitudinal direction X-X', for example over a distance equal to half the longitudinal length of the slits 17.

In order to form the tubular body 2 of the foam spring 1, the strip 8 is bent in such a way as is schematically represented by means of the dotted lines 15.

By doing so, the side walls 11 and 12 are brought dose together and are in a next step solidly fixed to one another, e.g. by gluing, thus forming the tubular body 2 of the foam spring 1.

As a result of the aforesaid, bending the strip 8 is stretched and the slits 17 are drawn open to form the aforesaid holes 3, which are radially extending through the body 2, and alternating with reinforcement ribs 7 created by the surrounding areas 18 that contain no slits, and hence will display no holes 3 when the tubular body 2 is formed at a later stage.

In case several rows 13 of the slits 17 are arranged in staggered configuration not only compared with one another but also compared with the slits 17 in the next area 16 separated by an area 18 containing no slits 17, the reinforcement ribs 7 thus formed at a later stage and represented in FIG. 1, obtain a wave or sine form, represented by the dotted line 14 in FIG. 1.

This wave or sine form of the reinforcement ribs 7 according to the invention is particularly suitable in converting any deflection of the spring 1 under compression in the direction of the arrow represented by P, into a tangential deformation of the sine shaped reinforcement ribs 7, thus preventing the spring 1 from bulging out radially, with all the negative consequences associated with it, as explained earlier.

Although according to a preferred embodiment of the invention the reinforcing ribs 7 extend over the total axial length L of the spring 1, it is not excluded that the reinforcing ribs 7 only extend over a part of said axial length L.

The invention is not necessarily limited to cylindrical springs 1, but can also be applied to other shapes of springs.

The present invention is by no means limited to the above-described embodiments and manufacturing method given as an example and represented in the accompanying drawings; on the contrary, such a foam spring and method for manufacturing such a spring can vary while still remaining within the scope of the invention.

What is claimed is:

1. A foam spring comprising:

an annular wall having an outside wall surface and an inside wall surface and defining within the inside wall surface a longitudinally extending and hollow interior area, the annular wall including:

a first plurality of longitudinally and radially extending sections, each of the first plurality of sections including at least one first relatively thin substantially solid radially extending wall extending from the outside wall surface through to the inside wall surface defining the hollow interior area;

a second plurality of substantially solid longitudinally and radially extending sections, each of the second plurality of sections interposed between respective ones of the first plurality of sections forming an alternating sequence of first and second sections around the annular wall, each of the second plurality of sections being relatively thicker than said first walls, and each of the second plurality of substantially solid sections radially extending through the annular wall from the outside wall surface through to the inside wall surface; and wherein, each of the first plurality of sections defines a plurality of apertures radially extending through the annular wall from the outside wall surface through to the inside wall surface, all or a portion of the apertures in each of the first plurality of sections being divided from one another by at least one said first relatively thin radially extending wall.

2. The foam spring according to claim 1, wherein the annular wall has a substantially uniform radial thickness across the first and second plurality of sections.

3. The foam spring according to claim 1 wherein the number of the second sections is between 4 and 12.

4. The foam spring according to claim 3, wherein the number of the second sections is between 6 and 10.

5. The foam spring according to claim 4, wherein the number of the second sections is 8.

6. The foam spring according to claim 1 wherein the second sections are equally spaced annularly about the annular wall.

7. The foam spring according to claim 1 further comprising:

a generally top side; and a generally bottom side, each of the alternating first and second sections extends the longitudinal length of the foam spring between the generally top side and the generally bottom side.

8. The foam spring according to claim 7 wherein each of the second plurality of sections comprises a solid foam rib uninterrupted by apertures.

9. The foam spring according to claim 8 wherein each of the second sections occupies a portion of the outside wall surface and at least one of the second sections has a sine wave shape over at least a portion of the longitudinal length of the annular wall.

10. The foam spring according to claim 1 further comprising a longitudinally extending seam.

11. The foam spring according to claim 10 wherein the longitudinally extending seam extends the entire longitudinal length of the foam spring, and extends through the annular wall from the outside wall surface through to the inside wall surface.

12. The foam spring according to claim 10 wherein the longitudinally extending seam comprises an adhesive binding together two mating foam surfaces.

13. The foam spring according to claim 1 wherein the spring constant of the foam spring is adjustable depending on the relative widths of one or more of the second sections.

14. The foam spring according to claim 1 wherein each of the second sections comprise reinforcement ribs.

15. The foam spring according to claim 1 wherein a plurality of the apertures has a diamond shape and are arranged in a staggered fashion within a respective one of the first sections.

16. The foam spring according to claim 1 wherein:

each of the plurality of apertures defined within the first plurality of sections includes a first cross-sectional area adjacent the outer wall surface and a second cross-sectional area adjacent the inner wall surface; and the first cross-sectional area being greater than the second cross-sectional area.

17. The foam spring according to claim 1 wherein:

at least one of the plurality of apertures defined within the first plurality of sections includes a first cross-sectional area adjacent the outer wall surface and a second cross-sectional area adjacent the inner wall surface; and the first cross-sectional area being greater than the second cross-sectional area.

18. The foam spring according to claim 1 further comprising:

a generally top side; and a generally bottom side, wherein each of the first sections includes two of said first walls, each of said first walls extending substantially between the top and bottom sides.

19. The foam spring according to claim 18 wherein a first portion of the apertures of at least one of the first sections is formed between one of said first walls and an adjacent second section.

20. The foam spring according to claim 19 wherein a second portion of the apertures is formed between one of said first walls and another adjacent second section.

21. The foam spring according to claim 20 wherein a third portion of the apertures is formed between the two first walls in each of the first sections.

22. The foam spring according to claim 19 wherein a third portion of the apertures is formed between the two first walls in each of the first sections.

23. The foam spring according to claim 1 further comprising:

a generally top side; and a generally bottom side, each of the at least one first wall extending the longitudinal length of the foam spring between the generally top side and the generally bottom side.

24. The foam spring according to claim 1 wherein at least one said first wall has a sinusoidal profile.

25. The foam spring according to claim 1 further comprising:

a generally top side; and a generally bottom side, wherein:

each of the first sections includes at least two of said first walls extending substantially between the top and bottom sides;

a first portion of the apertures of at least one of the first sections is formed between one of said first walls and an adjacent second section; and a second portion of the apertures is formed between two of the first walls in each of the first sections.

26. The foam spring according to claim 1 wherein:

at least one of the first sections includes two of said first walls extending substantially between the top and bottom sides; and a portion of the apertures is formed only between the two first walls in at least one of the first sections.

* * * * *